United States Patent [19]

Clive et al.

[11] Patent Number: 4,825,333

[45] Date of Patent: Apr. 25, 1989

[54] DRIVE CIRCUIT

[75] Inventors: Robert J. Clive, Cirencester; Keith R. Emerson, Hankerton, both of England

[73] Assignee: Lucas Industries Public Limited Company, Birmingham, England

[21] Appl. No.: 65,866

[22] Filed: Jun. 23, 1987

[30] Foreign Application Priority Data

Jul. 11, 1986 [GB] United Kingdom ..... 8616965

[51] Int. Cl.[4] ..... H01H 47/00

[52] U.S. Cl. ..... 361/154; 361/203

[58] Field of Search ..... 361/154, 187, 203, 152, 361/160, 168.1, 169.1; 123/490

[56] References Cited

U.S. PATENT DOCUMENTS 4,452,210 6/1984 Sasayama et al. ..... 361/154

4,546,403 10/1985 Nielsen ..... 361/154

*Primary Examiner*—L. T. Hix

*Assistant Examiner*—David M. Gray

*Attorney, Agent, or Firm*—Balogh, Osann, Kramer, Dvorak, Genova & Traub

[57] ABSTRACT

A drive circuit for an inductive load includes a switching device connected in series with the load and controlled by a constant frequency oscillator. The mark/space ratio of the signal supplied to the switching device by the oscillator can be varied in accordance with the output of a comparator 18 which compares the measured instantaneous value of the current flowing in the load with a calculated value of the current.

1 Claim, 1 Drawing Sheet

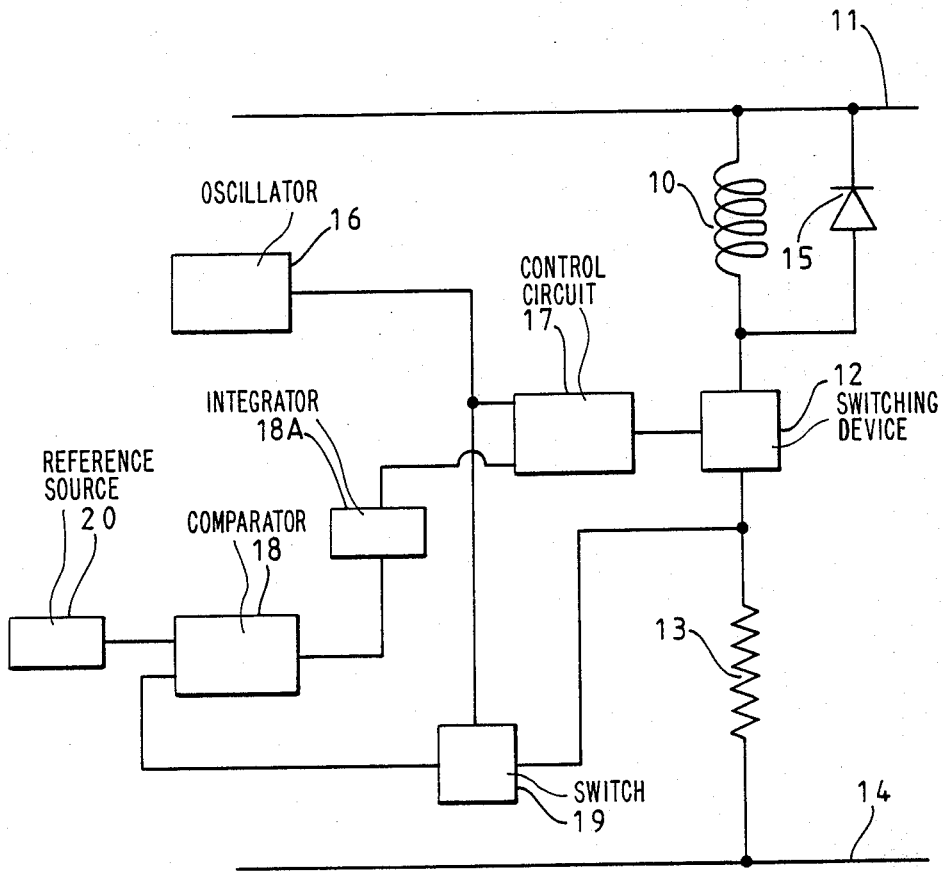
11
10
15
OSCILLATOR
16
CONTROL
CIRCUIT
17
12
SWITCHING
DEVICE
INTEGRATOR
18A
REFERENCE
SOURCE
20
COMPARATOR
18
13
SWITCH
19
14

DRIVE CIRCUIT

This invention relates to a drive circuit for an inductive load, the drive circuit being of the so-called constant frequency type and including a switching device connected in series with the load and a source of supply.

It is frequently necessary to control and vary the average current flowing in the inductive load and this can be achieved by varying the mark/space ratio. The difficulty arises in providing a measure of the average current since from the instant the switch on the current will increase exponentially in the load and if a flywheel diode is provided, from the instant of switch off will also decrease exponentially.

The object of the invention is to provide a drive circuit in a simple and convenient form.

According to the invention a drive circuit of the kind specified includes means for measuring the instantaneous value of the current flowing in the device at or after a predetermined time following switch on and means for comparing the measured instantaneus value of current with a calculated value of current, and further means for adjusting the mark/space ratio to achieve the desired average current flow in the load.

An example of a drive circuit in accordance with the invention is illustrated in the accompanying circuit diagram.

The drive circuit is intended to control the current flowing in an inductive load represented by the inductor 10, the inductive load being for example a proportional solenoid. One terminal of the load is connected to a d.c. supply line 11 and the other terminal of the load is connected by way of a switching device 12 and a resistor 13 connected in series, to the other supply line 14. The switching device may comprise a transistor. In addition, in parallel with the load 10 is a flywheel diode 15.

A constant frequency oscillator 16 is provided and this is connected to one input of a control circuit 17 the output of which controls the operation of the switching device 12. The control circuit also has an input which is connected to the output of a comparator 18 by way of an integrator 18A and one input of the comparator is connected by way of a switch 19 to a point intermediate the switching device 12 and the resistor 13. The other input of the comparator is connected to a reference source 20 and the operation of the switch 19 is controlled by the output of the oscillator 16.

In use, the control circuit 17 provides a square wave output signal to drive the switching device 12, the mark/space ratio being controlled by the output of the comparator 18 by way of the integrator 18A. The reference source 20 provdes a voltage representative of a desired instantaneous current to one input of the comparator and a voltage representing the actual instantaneous current in the load, is applied to the other input of the comparator by way of the switch 19 at the instant the switching device 12 is turned on or at a predetermined time after it has been turned on but before it is turned off. The voltage developed across the resistor 13 is representative of the instantaneous value of current and this is compared by the comparator 18 with the desired instantaneous value. Any deviation between the actual and desired value is corrected by adjustment of the mark/space ratio, the instantaneous value of the current being representative of the average current flowing in the load 10.

The reference voltage supplied by the source 20 is predetermined for given circuit conditions and any variation in the average current flowing in the load 10 will be corrected by the circuit. For example, if the supply voltage should fall which would, in the absence of any correction, cause a reduction in the average current flowing, the mark/space ratio will be adjusted to cause the average current to be restored to the desired value.

The operation of the control circuit may be controlled by a micro-computer which from the feedback signal representing the instantaneous value of current in the load 10 can control the control circuit 12 to obtain the desired average current flow in the load 10.

We claim:

1. A drive circuit for an inductive load, the drive circuit being of the so-called constant frequency type and comprising a switching device connected in series with the load and a source of electric supply, an oscillator for supplying a constant frequency signal, a control circuit having first and second inputs, said constant frequency signal being supplied to said first input, the control circuit having an output connected to said switching device, the output of the control circuit being a square wave signal having a mark/space ratio which is determined by the magnitude of a signal supplied to said second input of the control circuit, a comparator having first and second inputs and an output, a reference voltage source connected to the first input of the comparator, the output of the comparator being connected to the second input of the control circuit by way of an integrator, a resistor connected in series with said switching device and through which current flows to the load when the switching device is turned on by said square wave signal, the current flowing in said resistor producing a voltage signal across said resistor proportional to said current, and a switch through which said voltage signal is applied to the second input of the comparator, said switch being controlled by the constant frequency signal supplied by said oscillator and being arranged to be momentarily turned on to apply the voltage signal to the second input of the comparator at or a predetermined time after the switching device has been turned on but before it has been turned off.

* * * * *